US012447376B2

(12) United States Patent
Hywel

(10) Patent No.: US 12,447,376 B2
(45) Date of Patent: Oct. 21, 2025

(54) ISOLATION BAR FOR CHIN-UPS AND PULL-UPS

(71) Applicant: Steven Hywel, Bedminster, NJ (US)

(72) Inventor: Steven Hywel, Bedminster, NJ (US)

( * ) Notice: Subject to any disclaimer, the term of this patent is extended or adjusted under 35 U.S.C. 154(b) by 81 days.

(21) Appl. No.: 18/408,857

(22) Filed: Jan. 10, 2024

(65) Prior Publication Data

US 2025/0128120 A1 Apr. 24, 2025

Related U.S. Application Data

(63) Continuation-in-part of application No. 18/490,987, filed on Oct. 20, 2023, now Pat. No. 12,083,384.

(51) Int. Cl.

| | |
|---|---|
| ***A63B 23/12*** | (2006.01) |
| ***A63B 21/00*** | (2006.01) |
| ***A63B 21/068*** | (2006.01) |
| ***A63B 21/16*** | (2006.01) |

(52) U.S. Cl.

CPC .... *A63B 23/1218* (2013.01); *A63B 21/00047* (2013.01); *A63B 21/068* (2013.01); *A63B 21/1618* (2013.01); *A63B 21/4035* (2015.10); *A63B 2208/029* (2013.01)

(58) Field of Classification Search

CPC ..... A63B 21/1618; A63B 21/1627; A63B 21/1636; A63B 21/1645; A63B 21/1681; A63B 23/1218

See application file for complete search history.

(56) References Cited

U.S. PATENT DOCUMENTS

| | | | | |
|---|---|---|---|---|
| 3,593,708 | A * | 7/1971 | Steele | A61H 1/0218 602/32 |
| 4,077,403 | A * | 3/1978 | Steele | A63B 7/02 482/37 |
| 4,529,191 | A * | 7/1985 | Miller | A63B 1/00 482/40 |
| 4,531,514 | A * | 7/1985 | McDonald | A61H 1/0218 606/241 |
| 10,898,752 | B1 * | 1/2021 | Kehoe | A63B 23/03525 |
| 11,484,746 | B2 * | 11/2022 | Kehoe | A63B 23/03525 |
| D1,037,380 | S * | 7/2024 | Goulard | D21/679 |
| 2010/0234193 | A1 * | 9/2010 | Friedman | A63B 1/00 482/133 |
| 2013/0244836 | A1 * | 9/2013 | Maughan | A63B 23/1227 482/40 |
| 2014/0135183 | A1 * | 5/2014 | Inglut | A63B 23/1227 482/96 |
| 2021/0331026 | A1 * | 10/2021 | Jones | A63B 23/1218 |
| 2021/0379435 | A1 * | 12/2021 | Harker | A63B 1/00 |

* cited by examiner

*Primary Examiner* — Zachary T Moore

(74) *Attorney, Agent, or Firm* — Michael J. Feigin, Esq.; Feigin and Fridman LLC

(57) ABSTRACT

An isolation bar for a chin-up or pull-up bar extends parallel or at an acute angle (angled facing upwards) and is below a grasping region of the chin-up or pull-up device. The isolation bar can be hung from the chin-up or pull-up bar by way of cables/elongated straps or be fixed to a door frame, wall mounted, or free standing device with the grasping region. In use, the forearms of a user are pushed against the isolation bar while carrying out a chin-up or pull-up.

12 Claims, 7 Drawing Sheets

ISOLATION BAR FOR CHIN-UPS AND PULL-UPS

FIELD OF THE INVENTION

The present invention relates to exercise devices and, more specifically, to a latissimus dorsi and bicep isolation bar for pull-ups and chin-ups, respectively.

BACKGROUND

Chin-ups and pull-ups are exercises performed to increase the strength of the upper body. One grasps a horizontal bar, typically, or other handles above the ground, and hangs therefrom. The exercising person then pulls upwards, primarily contracting their latissimus dorsi and biceps, raising the body upwards towards the bar.

Pulls-ups strengthen the biceps and back muscles including the trapezius muscles which extend from the neck to the shoulders, the latissimus dorsi muscle which extends from middle of the back to the armpit, the thoracic erector spinae which extends along your thoracic spine, and the infraspinatus on the shoulder blade.

However, difficulties with pull-ups and chin-ups include isolating specific muscles and activating undesired muscles by failing to remain a proper and stable angle while lifting upwards. Currently, there is no known method that allows the user to stabilize, or substantially stabilize, their arms, and thus their body, to better target specific muscles and/or muscle groups, without utilizing/activating, to a large extent, secondary muscles and/or muscle groups, due to natural body mechanics.

What is needed is an exercise which has the benefits of pull-ups and chin-ups while allowing the arms and muscles thereon to be in a stable position while lifting a body upwards in order to allow for better targeting of desired muscles and a more efficient workout.

SUMMARY OF THE DISCLOSED TECHNOLOGY

An exercise device, such as one used for pull ups or chin-ups of embodiments of the disclosed technology has an isolation bar. The exercise device is one with handles, generally positioned above a person, designed to be grasped by, and withstand the forces of, a person pulling on the handles or other grasping region (position designed to be pulled on by a person). Such handles can be part of a beam or elongated rod such as one of metal which can be covered with foam. As such, the exercise device can be one which freestanding or which is temporarily held within a door frame and/or mounted on a vertical surface such as a wall.

The isolation bar is below the handles or grasping region. In this disclosure, directional terminology refers to typical usage relative to the ground. Thus, "above" refers to further away from the ground than "below". The "ground" is a solid surface of a planet, e.g. Earth. In a typical usage of the exercise device of the disclosed technology, one grasps the handles and/or bar above himself, primarily contracts his latissimus dorsi and bicep muscles, and pulls his entire body (excluding forearms) upwards. With the isolation bar, one rests his forearms and/or elbows on the bar (directly or by way of pads on the bar). The isolation bar is in line with or at an acute angle to the handles there-above such that a person pulling his body upwards while using the exercise device is simultaneously applying force against the isolation bar, the bar holding his forearms in place avoiding "wobble" or undesirable horizontal movement of the arms. This allows one to better target the latissimus dorsi during a pull-up and biceps during a chin-up during pull ups or chin ups. ("Horizontal" is, in this disclosure, in parallel to a most elongated linear portion of the isolation bar and/or a bar to be grasped and/or is parallel to the ground.)

Said another way, the isolation bar has a contact region for the forearms and/or elbows, in line with, and/or at an acute angle relative to a horizontal line extending between the two spaced apart grasping regions of an upper bar/upper handles of the exercise device. A vertical plane, perpendicular to the horizontal line, extends between the ground and the horizontal line, and the contact region is in line with, and/or outside of the vertical plane (in "front" of the vertical plane which is closer to a user using the device as designed with forearms placed on the isolation bar/pads on the isolation bar).

The isolation bar can be fixed in space (that is, fixed in a position relative to the ground below and/or) relative to the two spaced apart grasping regions. The contact region, in some embodiments, is rotatably adjustable relative to the two spaced apart grasping regions. The notation, in some embodiments, includes rotation of the isolation bar relative to vertical direction due to a change in angle of the wheels as pressure is applied by human force on the isolation bar. The "wheels" are defined as cylindrical shaped semi-circle such as half of a wheel shape, being affixed to the bar, the wheels on a side of the isolation bar opposite the contact region (the "back" side, opposite the "front" side). The wheels are adapted to be pressed against a fixed vertical structure, such as a door frame, and rotation of the wheels causes an angle change of the contact region. The contact region, in some embodiments of the disclosed technology, becomes fixed in space when pressure is applied mostly or fully perpendicular to the vertical plane (such as by forearms when using the exercise device to carry out pull ups or chin ups).

In a version of the exercise device which is held on a door frame, two spaced apart grasping regions are on a first bar and the first bar is below a shorter, equal length, or longer second bar. The first bar and the second bar are adapted to hold the pull-up exercise device in place within a doorway. The device can further have spaced apart vertical straps extending from one of the first bar and the second bar towards the ground. Such vertical straps can be flexible allowing the isolation bar to move to and fro, the vertical straps connecting the isolation bar to one of the first and second bars which are nearer to, or above, the door frame. Other pull-up and chin-up bars known in the art can also be used such as those with a single bar mounted between the door frame or wedged in place.

Substantially, or an entirety, of the isolation bar is at the acute angle to the first bar in some embodiments of the disclosed technology. In other embodiments, the isolation bar extends such that the front side is parallel to the vertical plane)

In a method of using the above device to do pull-ups or chip-ups (the device with two spaced apart grasping regions held in place relative to the ground, and an isolation bar) one does as follows. While pressing forearms against contact regions of the isolation bar, the bar being in line with and/or at an acute angle relative to the horizontal, one pulls on each of the two spaced apart grasping regions while pressing both forearms into the isolation bar. Each arm is then stabilized relative to the isolation bar (stabilized, being defined as "held in place" or "substantially held in place").

The two spaced apart grasping regions are on a first bar, the first bar below a shorter second bar in some embodiments. In such embodiments spaced apart vertical straps extend from one of the first or second bars towards the ground and the exercise device is placed on a door frame with the first bar above the door frame and the second bar below the door frame, or the second bar above the door frame and the first bar below the door frame. In some embodiments, a bar of the exercise device rests on molding/a lintel of the door.

DETAILED DESCRIPTION OF EMBODIMENTS OF THE DISCLOSED TECHNOLOGY

An isolation bar for a chin-up or pull up-bar extends at—an acute angle (angled facing upwards) or parallel along the same vertical plane, and is below a grasping region of the chin-up or pull-up device. The isolation bar can be hung from the chin-up or pull-up bar by way of cables/elongated straps or be fixed to a door frame or free standing device with the grasping region. In use, the forearms (or elbows) of a user are pushed against the isolation bar while carrying out a chin-up or pull-up.

Embodiments of the disclosed technology will become more clear in view of the following description of the figures.

Figure 1:
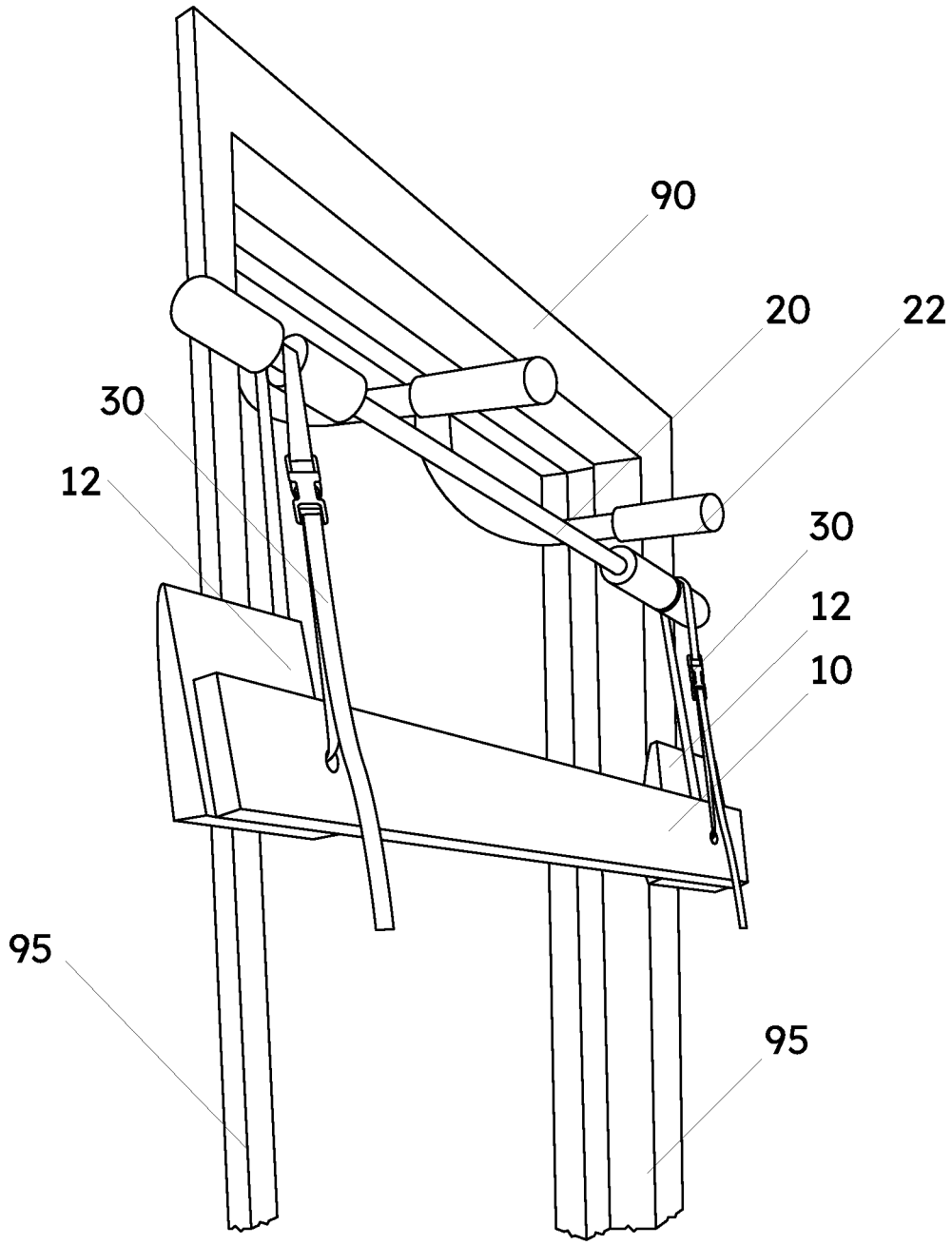
FIG. 1 shows a first isolation bar of an embodiment of the disclosed technology hanging from straps attached to a pull-up bar held in a door frame.

FIG. 1 shows a first isolation bar of an embodiment of the disclosed technology hanging from straps attached to a pull-up bar held in a door frame. The isolation bar 10 has a substantially or fully flat front side and back side adapted for placement of a forearm (including either of, or excluding each or both of, a wrist and elbow). The isolation bar 10 is wider than a width of a door frame with sides 95 a lintel 90 such that in use, the isolation bar 10 abuts or is held against the door frame sides 95. The isolation bar 10 is held against the door frame either via direct physical contact or by way of pads 12. The pads 12, shown in FIG. 1, are a wedge shape having a narrower top side closest to the lintel and/or pull-up bar 20. A wider lower side (towards the ground/a side away from the lintel 90) creates the wedge shape with, for example, a flat front side (facing the isolation bar 10/facing away from the sides of the door frame 95) and angled side of the wedge which faces towards and/or abuts the door frame sides 95. As such, the isolation bar 10 is positioned at an acute angle relative to the elongated length of the bar 20. At such an acute angle, forearms placed there against the isolation bar 10 fixed with respect to the door or doorway and such that elbows of a user are further away from the door or doorway than the wrists when using the pull-up bar. The elbows can be inline with the users hands/wrists in some embodiments of the disclosed technology.

The isolation bar 10 is further, in this embodiment, held by straps 30 such as those with an adjustable length. In the embodiment shown, portals extending through the isolation bar 10 are used to pass the straps there-through such that the bar 10 hangs from the straps. Given that the pads 12 (in this case, wedges) are between the bar 10 and sides of the door frame 95 while the bar 20 is closer to the sides of the door frame 95, the isolation bar 10 rest against the door frame (directly or by way of the pads 12). The isolation bar 10 is thus stabilized in a resting condition (when the pull-up bar is not in use for exercise).

In this embodiment, the elongated bar 20 (also referred to as a "first bar") is held against the door frame by way of anchoring the pull-up bar on either side of the lintel 90. Pull-up bars which attach in this manner are known in the art, and can be found in the prior art submitted with this application. For purposes of this invention, this embodiment has any pull-up bar held against stable vertical sides walls, such as the sides of a door frame 95. The terms pull-up bar and chin-up bar used interchangeably in this disclosure and refers to an exercise device where one flexes and/or contracts, at least one of, biceps and latissimus dorsi muscles to lift oneself upwards or substantially upwards and away from the ground. Such a bar can have grasping regions, designed for grasping with one's hand(s) to pull up thereon, such as along or on the elongated bar 20 or perpendicular handles 22 extending away from the elongated bar 20. Such a door-held pull-up bar has a horizontal bar on one side of a lintel 90 and a second, wider, horizontal bar on a second side of the lintel as shown.

Figure 2:
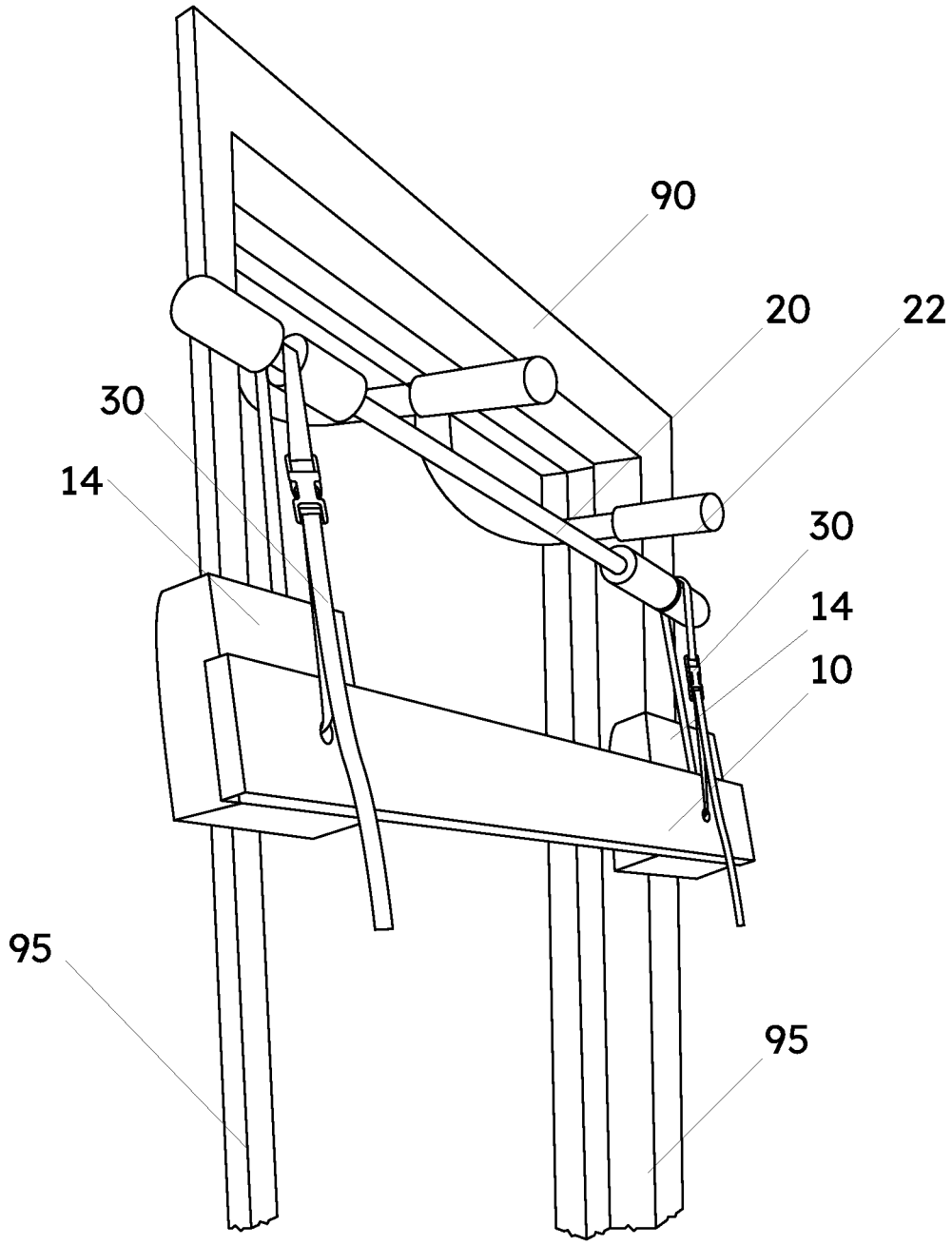
FIG. 2 shows a second isolation bar of an embodiment of the disclosed technology hanging from straps attached to a pull-up bar held in a door frame.

FIG. 2 shows a second isolation bar of an embodiment of the disclosed technology hanging from straps attached to a pull-up bar held in a door frame. Similar to the first embodiment, this embodiment varies in that the pads 14 have less of a wedge angle, or no wedge angle such that the pads 14 are held along one side flash with the door frame 95 or only tapered at a top end there-of which abuts the door frame 95. In this embodiment the isolation bar is again at an acute angle relative to the bar 20 and/or at an obtuse angle relative to the ground such that a/the top side of the isolation bar is closer to the door frame 95 and/or elongated bar 20 than a bottom side thereof. For purposes of this disclosure, "top" refers to a direction extending away from a ground on which device of the disclosed technology are held and "bottom" refers to a direction extending towards said ground.

Figure 3:
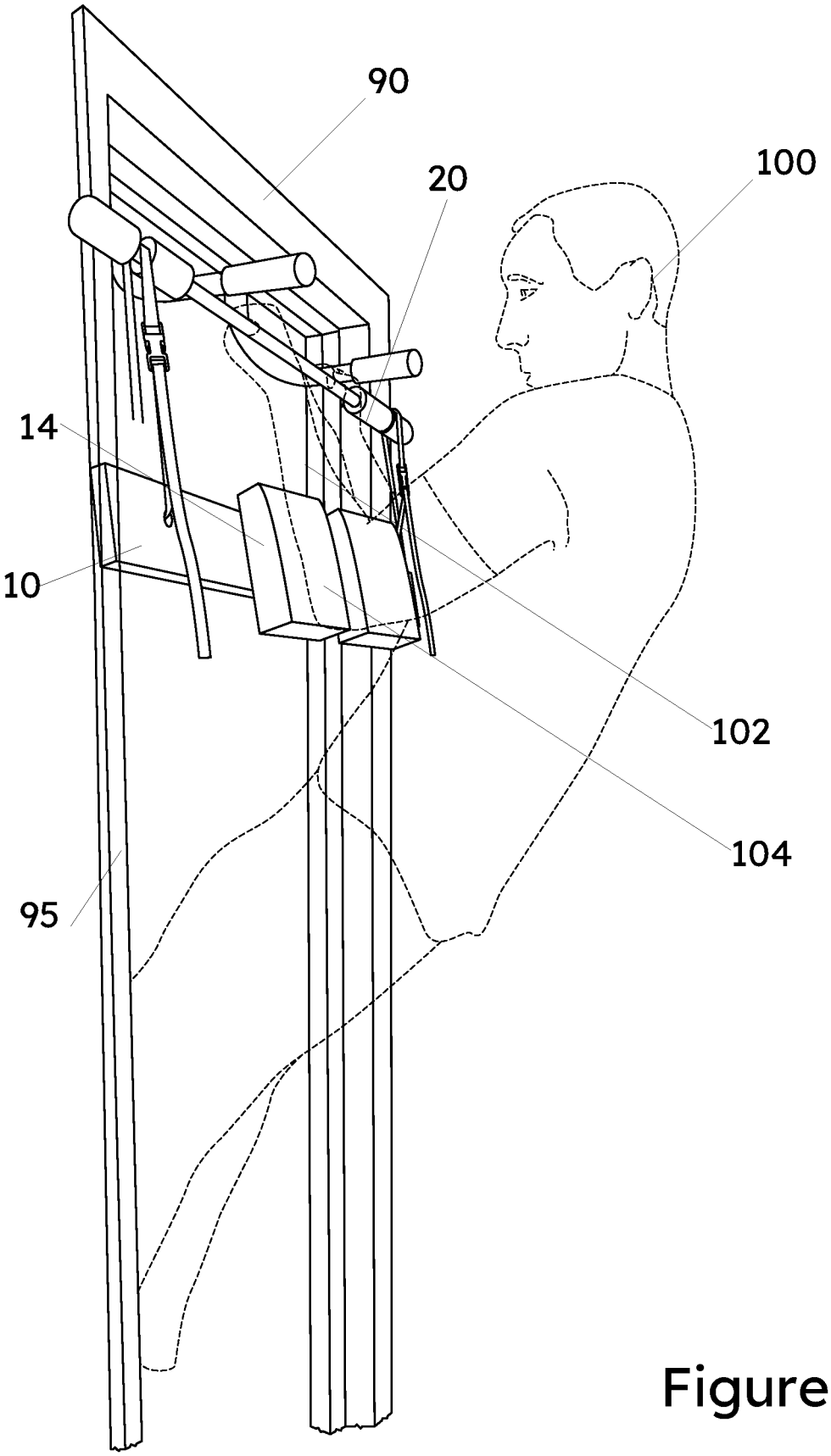
FIG. 3 shows a third isolation bar of an embodiment of the disclosed technology hanging from straps attached to a pull-up bar held in a door frame.

FIG. 3 shows a third isolation bar of an embodiment of the disclosed technology hanging from straps attached to a pull-up bar held in a door frame. In this embodiment a person 100 is shown using the isolation bar 10 by placing his forearms 102 and elbows 104 against pads 14 which are on a front side of the isolation bar 10. "Front" refers to a side of an object which faces a user or intended user of a device or part thereof while "back" refers to a direction opposite "front" and/or towards a door frame or other object hold the bar 20 in place. Here the isolation bar 10 is held against the door in a manner which is either perpendicular to the door frame sides 95 (at the most elongated and flat region of the isolation bar 10) and/or is acutely angled by way of tension from the straps 30 and/or a tapered back side of the isolation bar 10. In some embodiments, the pads 12 are tapered causing the acute angle on a front side of the device, where a person's body (forearm) rests against the pads 14. In some embodiments, the isolation bar 10 is split into a top and bottom region with horizontal portal there-between. This allows the bar to be lighter and ship more easily than a solid bar, such as the bar shown in FIG. 1. Described another way, the bar 10 can have an upper bar and lower bar thereof, which are connected at sides thereof, such as connected only within 10% or 25% of the length from each horizontal side edge. The pads extend over the upper bar and lower bar of the isolation bar in embodiments of the disclosed technology.

Figure 4:
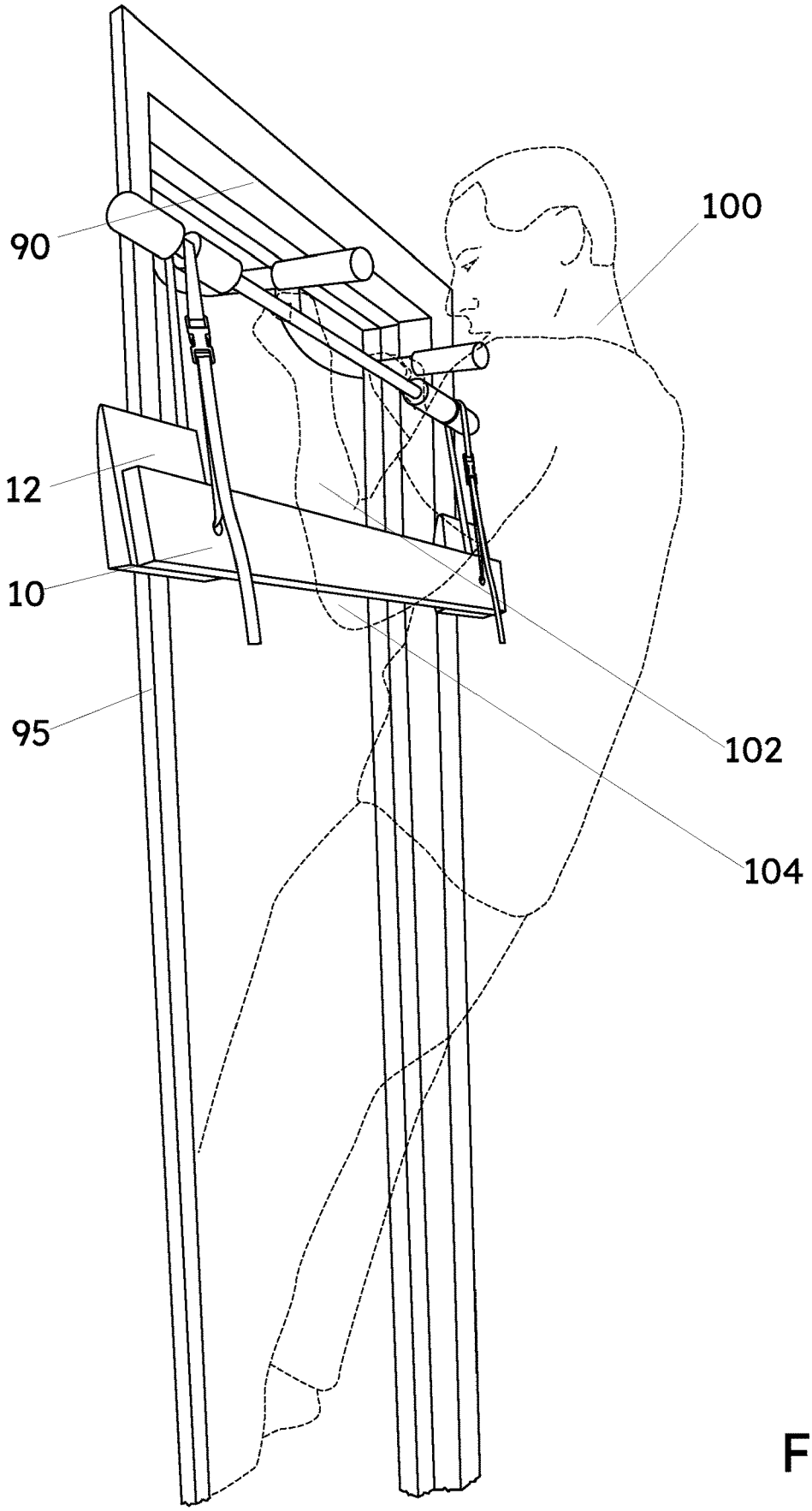
FIG. 4 shows a fourth isolation bar of an embodiment of the disclosed technology hanging from straps attached to a pull-up bar held in a door frame.

FIG. 4 shows a fourth isolation bar of an embodiment of the disclosed technology hanging from straps attached to a pull-up bar held in a door frame. In this embodiment the tapered version of the pads 12 as shown and described with reference to FIG. 1 are used. The person 100 has placed his forearm 102 against the isolation bar 10 and is grasping a grasping region of the pull-up bar 10. Here, while a person pulls his body in a generally, substantially, or fully upwards/vertical direction, the forearms 102 are prevented from moving or substantially moving relative to the isolation bar 10. The isolation bar 10 holds the forearms stable (in place) while performing a pull-up or chin-up allowing for isolating muscles being used to conduct the exercise. In this manner, for example, only, or substantially only, or a majority thereof, the bicep is engaged during the pull-up/chin-up avoiding sway of the body of the user 100 and undesired usage of lateral or other muscles.

Figure 5:
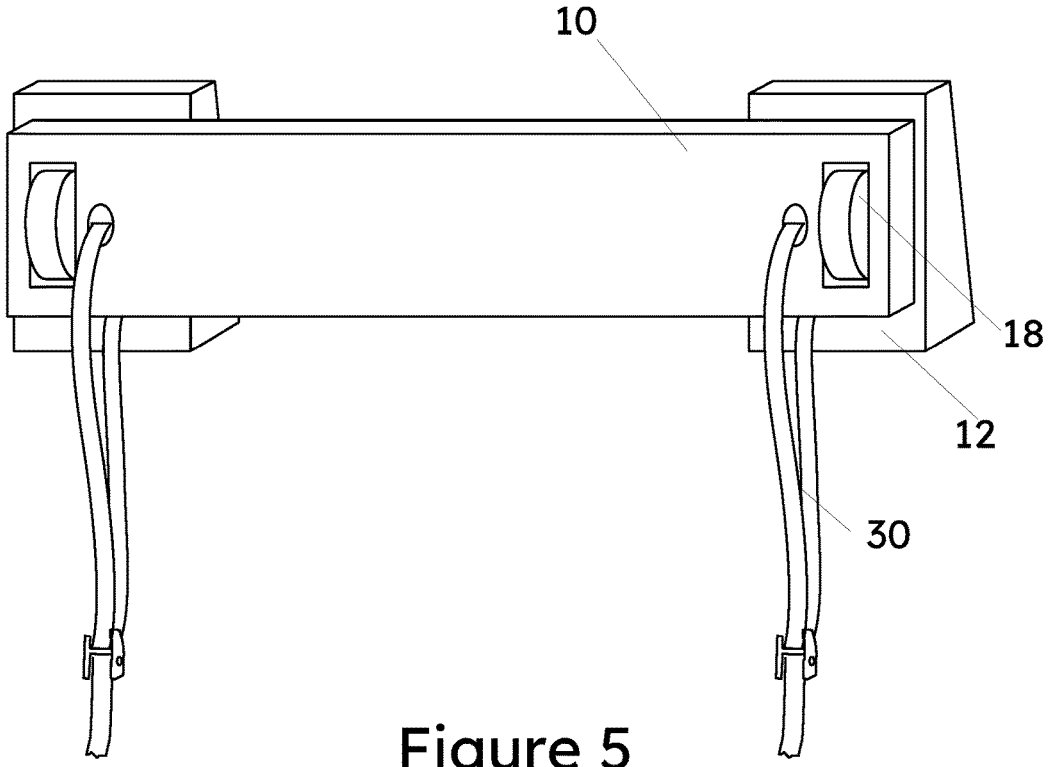
FIG. 5 shows a fifth isolation bar of an embodiment of the disclosed technology.

FIG. 5 shows a fifth isolation bar of an embodiment of the disclosed technology which is hung from straps attached to a pull-up bar held in a door frame. Here, wheels 18 are used to hold the isolation bar 10 against a door frame or other stationary and substantially, or fully, vertical surface. Thus, as one placing pressure against pads 12 while using the exercise device, the angle of the isolation bar with respect to a vertical plane is changeable and/or changes during use.

Figure 6:
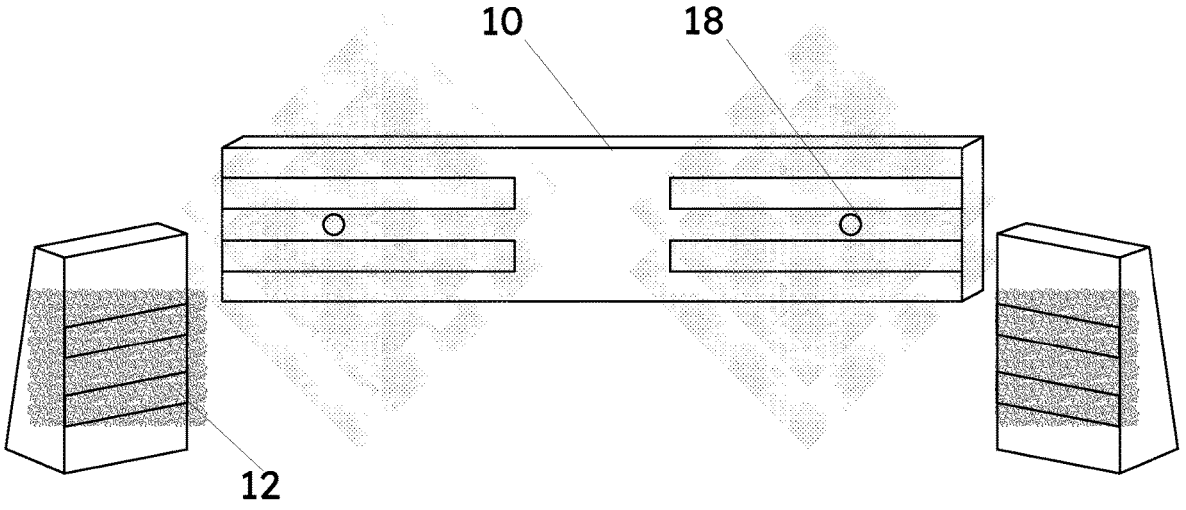
FIG. 6 shows a sixth isolation bar of an embodiment of the disclosed technology.

FIG. 6 shows a sixth isolation bar of an embodiment of the disclosed technology which is hung from straps attached to a pull-up bar held in a door frame. This isolation bar 10 has portals 18 through which the elongated straps 30 can pass through, thereby holding the isolation bar in place. A version of the isolation bar with portals 18 can be used with the embodiments described previously with respect to FIGS. 1 through 5.

Figure 7:
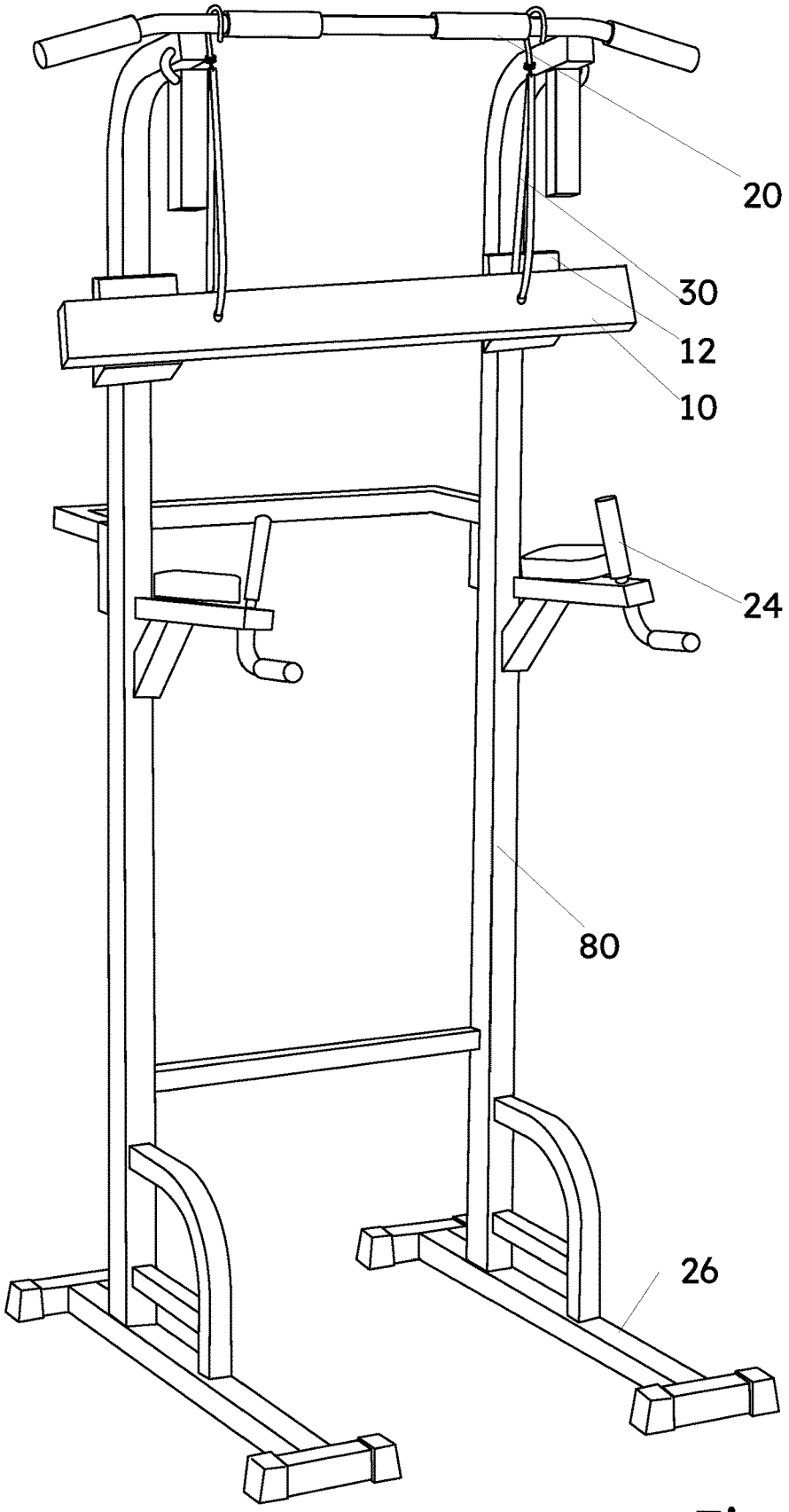
FIG. 7 shows a seventh isolation bar of an embodiment of the disclosed technology hanging from straps attached to a pull-up bar held on a free-standing device.
Figure 8:
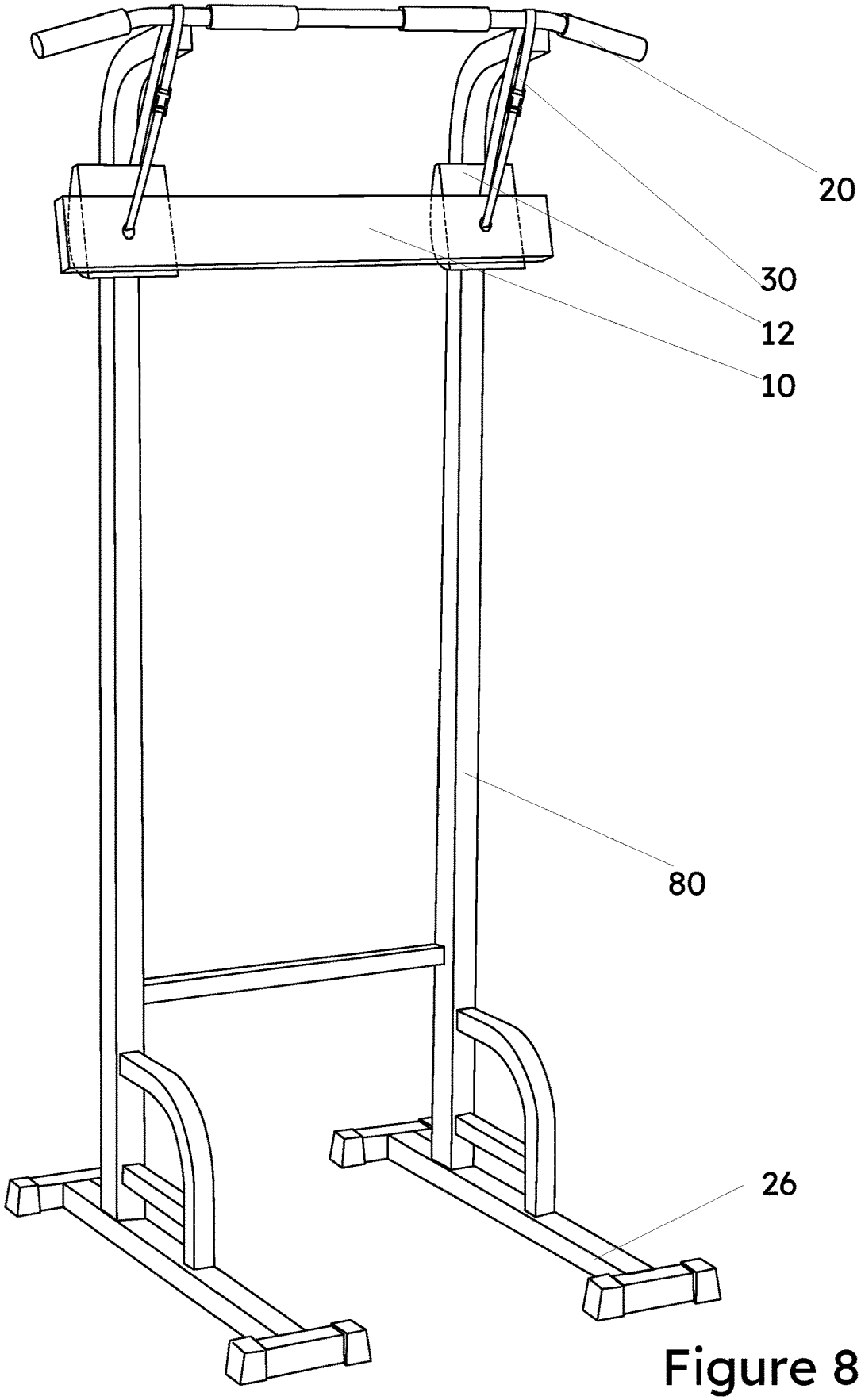
FIG. 8 shows a seventh isolation bar of an embodiment of the disclosed technology hanging from straps attached to a pull-up bar held on a second free-standing device

FIG. 7 shows a seventh isolation bar of an embodiment of the disclosed technology hanging from straps attached to a pull-up bar held on a free-standing device. FIG. 8 shows a seventh isolation bar of an embodiment of the disclosed technology hanging from straps attached to a pull-up bar held on a second free-standing device. The free-standing device has a support base 26 on a floor/lower extremity of the device with vertically extending members 80 (analogous to the sides of a door frame 95 shown in other embodiments). The bar 20 to grasp while carrying out exercises is thus held in place relative to the ground. The isolation bar 10 then hangs from the bar 20 by way of straps 30 and can have pads 12 of 14 and other parts of the devices shown in FIGS. 1 through 6. Grasping handles 24 (see other figures), which extend outwards from between the isolation bar 10 and base 26 can also be present.

For purposes of this disclosure, the term "substantially" is defined as "between 95% and 100%, inclusive" of the term which it modifies.

Any device or aspect of the technology can "comprise" or "consist of" the item it modifies, whether explicitly written as such or otherwise.

When the term "or" is used, it creates a group which has within either term being connected by the conjunction as well as both terms being connected by the conjunction.

The term "and/or" is inclusive of the items which it joins linguistically, and each item by itself.

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described herein-above are also contemplated and within the scope of the invention.

The invention claimed is:

1. An exercise device with an isolation bar, comprising:

a grasping bar situated above said isolation bar, adapted for placing forearms and/or elbows against said isolation bar while grasping said grasping bar;

tapered pads extending vertically on a back side and at an acute angle on a front side;

wherein straps hold said isolation bar to said grasping bar causing said distance between said isolation bar and said grasping bar to be adapted for said placing of said forearms and/or said elbows against said isolation bar while grasping said grasping bar.

2. The exercise device of claim 1, wherein said pads are wedge shaped.

3. The exercise device of claim 2, wherein said isolation bar hangs freely from said grasping bar.

4. The exercise device of claim 2, wherein attachment of the combination of said isolation bar and said tapered pads consists of attachment to a grasping bar.

5. The exercise device of claim 1, wherein said grasping bar is fixed to a door frame and said isolation bar is unattached to said door frame.

6. The exercise device of claim 1, wherein said tapered pads are against a door frame and said grasping bar extends across said door frame.

7. The exercise device of claim 6, wherein each strap of said straps is vertically aligned with a tapered pad of said tapered pads.

8. The exercise device of claim 6, wherein each strap of said straps passes through a tapered pad of said tapered pads.

9. An exercise device with an isolation bar, comprising:

a grasping bar situated above said isolation bar, adapted for placing forearms and/or elbows against said isolation bar while grasping said grasping bar;

tapered pads extending vertically on a back side and at an acute angle on a front side;

wherein said grasping bar is fixed to a door frame and said isolation bar is unattached to said door frame; and wherein a plurality of straps extends from said grasping bar to said isolation bar, each strap of said plurality of straps being closer to said door frame than a horizontal center of said isolation bar.

10. The exercise device of claim 9, wherein each said strap of said plurality of straps extends from between two pads of said grasping bar.

11. The exercise device of claim 10, wherein a first pad of said two pads is positioned against said door frame and a second pad of said two pads is forms a grasping region of said grasping bar.

12. An exercise device with an isolation bar, comprising:

a grasping bar situated above said isolation bar, adapted for placing forearms and/or elbows against said isolation bar while grasping said grasping bar;

tapered pads extending vertically on a back side and at an acute angle on a front side;

wherein said isolation bar is held to said grasping bar by way of flexible straps placed against uprights which support said grasping bar.

* * * * *